US009561401B2

(12) United States Patent
Wiseman

(10) Patent No.: US 9,561,401 B2
(45) Date of Patent: Feb. 7, 2017

(54) MONOFIN SWIMMING APPARATUS

(71) Applicant: Sun Tail Mermaid, LLC, Anchorage, AK (US)

(72) Inventor: Jessica Wiseman, Rock Springs, WY (US)

( * ) Notice: Subject to any disclaimer, the term of this patent is extended or adjusted under 35 U.S.C. 154(b) by 0 days.

(21) Appl. No.: 14/726,010

(22) Filed: May 29, 2015

(65) Prior Publication Data

US 2015/0343268 A1 Dec. 3, 2015

Related U.S. Application Data

(60) Provisional application No. 62/006,169, filed on Jun. 1, 2014.

(51) Int. Cl.
*A63B 31/08* (2006.01)
*A63B 31/11* (2006.01)

(52) U.S. Cl.
CPC ..... *A63B 31/11* (2013.01); *A63B 2209/00* (2013.01); *A63B 2225/096* (2013.01)

(58) Field of Classification Search
CPC ..... A63B 31/08; A63B 31/10; A63B 31/11
USPC ..... 441/64
See application file for complete search history.

(56) References Cited

U.S. PATENT DOCUMENTS 3,344,449 A 10/1967 Grilli
3,934,290 A 1/1976 Le Vasseur
4,541,810 A 9/1985 Wenzel
4,781,637 A 11/1988 Caires
5,429,536 A 7/1995 Evans
D379,398 S 5/1997 Garraffa et al.
D415,544 S 10/1999 Applegate
6,086,440 A 7/2000 Fechtner
6,309,270 B1 * 10/2001 Harwell, IV ..... A63B 31/08 2/428
6,375,530 B1 4/2002 Earl
6,764,362 B1 * 7/2004 Wenzel ..... A63B 31/11 441/64

(Continued)

FOREIGN PATENT DOCUMENTS

DE 19934556 1/2001
WO 9211176 7/1992

OTHER PUBLICATIONS

Web page download, May 31, 2011, Mermaid Tails website: www.mermaidtails.net, 11 pages, accessed on Jan. 12, 2016.

(Continued)

*Primary Examiner* — Stephen Avila
(74) *Attorney, Agent, or Firm* — Schmeiser, Olsen & Watts LLP

(57) ABSTRACT

A monofin, for use in swimming, includes a fin shaped like a whale tail, wherein the fin further includes a leading edge and a trailing edge. At least one corrugation is formed in the fin, wherein the at least one corrugation is parallel to a portion of the leading edge. At least one foot pocket assembly may be removably coupled to the fin. The at least one foot pocket assembly includes a foot pocket cover formed to removably couple around a portion of the fin. At least one foot opening is formed in the foot pocket cover and at least one cuff surrounds the at least one foot opening. At least one foot pocket is in communication with the at least one foot opening. The at least one cuff stretches to encompass an ankle of users of many sizes and holds the monofin on the users.

19 Claims, 9 Drawing Sheets

(56) References Cited

U.S. PATENT DOCUMENTS

| | | | | |
|---|---|---|---|---|
| 8,382,542 | B2 | 2/2013 | Pakhomov | |
| 8,628,365 | B2 * | 1/2014 | Burdick | A63B 31/11 441/64 |
| 8,632,372 | B2 | 1/2014 | Fleck | |
| 9,162,110 | B1 | 10/2015 | Browning et al. | |
| 2009/0170388 | A1 * | 7/2009 | Bonis | A63B 31/11 441/64 |
| 2010/0099312 | A1 | 4/2010 | Shieh | |
| 2011/0217890 | A1 | 9/2011 | Fleck | |
| 2011/0250818 | A1 | 10/2011 | Geurts | |
| 2012/0252289 | A1 | 10/2012 | Johnson | |
| 2014/0199902 | A1 | 7/2014 | Suciu | |

OTHER PUBLICATIONS

Web page download, Sep. 17, 2010, Aqua Tails website: www.aquatails.com, 8 pages, accessed on Jan. 12, 2016.
Web page download, Oct. 6, 2008, Mermagica website: www.mermagica.com, 3 pages, accessed on Jan. 12, 2016.
Web page download, May 9, 2013, Mermaid Fin website: www.mermaidfin.com, 1 page, accessed on Jan. 12, 2016.
Web page download, Jun. 25, 2014, The Mertailor website: https://themertailor.com/monofin-flipper, 7 pages, accessed on Jul. 12, 2016.
Web page download, Aug. 29, 2005, Metro Swim Shop website: www.metroswimshop.com/product.Finis%20Wave.htm#.
U0cNqtJOWcw, 4 pages, accessed on Jan. 12, 2016.
Web page download, Aug. 24, 2012, Miami Beach Mermaids website: http://www.miamibeachmermaids.com/#lmermaid-store/c1sn6, 2 pages, accessed on Jan. 12, 2016.
Web page download, Jan. 18, 2015, Finis Mermaid Swim Fin website: http://www.finisinc.com/Mennaid-Swim-Fin, 3 pages, accessed on Jul. 12, 2016.
Web page, Jul. 7, 2011, Magictail youtube video: https://www.youtube.com/watch?v=toWbMm6t5KI, 4 pages, accessed on Jul. 12, 2016.
Web page, Mar. 6, 2013, My Magictail Mermaid Tail youtube video: https://www.youtube.com/watch?v=aVZc3tS1Yjk, 3 pages, accessed on Jul. 12, 2016.
Web page, Mar. 9, 2011, Magictail Mermaid Gathering youtube video: https://www.youtube.com/watch?v=HjgaelVjKEc, 4 pages, accessed on Jul. 12, 2016.
Web Page, Mar. 20, 2013, Magic Tail Review youtube video: https://www.youtube.com/watch?v=QJapK1mCq0c, 4 pages, accessed on Jul. 12, 2016.
Web page, Mar. 28, 2013, Putting on the Magictail Mermaid Tail youtube video: https://www.youtube.com/watch?v=xDwZZDUgVoA, 4 pages, accessed on Jul. 12, 2016.
Web page, Jan. 14, 2012, How to Put on a Magic Tail Mermaid Tail youtube video: https://www.youtube.com/watch?v=gOoie0UQaYw, 3 pages, accessed on Jul. 12, 2016.
Web page, Jul. 30, 2013, Mermaid Tail Review youtube video: https://www.youtube.com/watch?v=19dW8JFgurw, 4 pages, accessed on Jul. 12, 2016.
Web page, Sep. 11, 2012, Review of My Mermaid Tail—Magictail youtube video: https://www.youtube.com/watch?v=mfnUKB5DqX8, 4 pages, accessed on Jul. 12, 2016.
Web page, Feb. 11, 2014, Unboxing—Review Magictail youtube video: https://www.youtube.com/watch?v=JJ4wtimvQZI, 4 pages, accessed on Jul. 12, 2016.
Web page, Jan. 5, 2013, My Mermaid Tail youtube video: https://www.youtube.com/watch?v=WCVbg2GMDm4, 3 pages, accessed on Jul. 12, 2016.
Web page, Nov. 4, 2014, Lets Talk About Monofins! Finfun Mermaid and Magictail.de youtube video: https://www.youtube.com/watch?v=UA_baV1gTI8, 4 pages, accessed on Jul. 12, 2016.
Web page download, Mar. 27, 2012, Speedo Kids Swim Fin: http://www.swimoutlet.com/p/speedo-kids-swim-fin-17264/?gclid=CMDMwYb7mMwCFYVrfgodDJQJ2g, 5 pages, accessed on Jan. 12, 2016.
Web page download, Jan. 25, 2015, Finis Wave Monofin website: http://www.finisinc.com/Wave-Monofin, 3 pages, accessed on Apr. 22, 2016.
Web page download, Jan. 26, 2015, Finis Rapid Monofin website: http://www.finisinc.com/Rapid-Monofin, 4 pages, accessed on Apr. 22, 2016.
Web page download, Nov. 27, 2015, Finis Shooter Monofin website: http://www.finisinc.com/Shooter-Monofin-XL, 5 pages, accessed on Apr. 22, 2016.
Web page download, Jun. 8, 2015, Finis Competitor Monofin website: http://www.finisinc.com/Competitor-Monofin-XL, 4 pages, Apr. 22, 2016.
Web page download, Finis Trainer Monofin website: http://www.finisinc.com/Trainer-1-Monofin-XXL, 4 pages, accessed on Apr. 22, 2016.
Web page download, Jan. 8, 2015, Finis Foil Monofin website: http://www.finisinc.com/Foil-Monofin, 4 pages, accessed on Apr. 22, 2016.

* cited by examiner

MONOFIN SWIMMING APPARATUS

CROSS-REFERENCE TO RELATED APPLICATION

The present application is related to and claims priority to prior U.S. Provisional Patent Application Ser. No. 62/006,169, entitled "MONOFIN SWIMMING APPARATUS", filed Jun. 1, 2014 the relevant portions of said application are incorporated herein by reference.

BACKGROUND OF THE INVENTION

Technical Field

This invention relates to a monofin for use when swimming.

Background Art

A monofin is a type of swimming fin. A typical monofin consists of a single fin with foot pockets that hold the user's feet to the fin.

Monofins are often used in underwater sports such as finswimming, free-diving and underwater orienteering. Additionally, monofins have become very popular with children and adults who want to swim like a dolphin or a mermaid.

Typical monofins, however, have many problems. The hard rubber and straps used for the foot pockets in typical monofins can cause blisters on the user's feet. Additionally, typical foot pockets may be uncomfortable or may not fit atypical feet, such as feet with high arches or the like.

The fins, themselves, may also be easily broken. Landing on or pushing off the edge of the fin may cause it to break. Additionally, children tend to be abuse monofins and often break the fin portion.

Accordingly, what is needed is a monofin that is comfortable to use and which has a fin that is very durable while allowing enough flexibility for the monofin to function correctly.

DISCLOSURE OF THE INVENTION

The monofin, as disclosed hereafter in this application, is strong, durable, comfortable and automatically adjusts to many different sizes of users.

In particular embodiments, a monofin includes a fin having a leading edge and a trailing edge. At least one corrugation may be formed in the fin parallel to a portion of the leading edge. At least one foot pocket is coupled to said fin.

Additional embodiments of a monofin may include a fin with at least one foot pocket assembly removably coupled to the fin. Wherein the at least one foot pocket assembly includes a foot pocket cover formed to removably couple around a portion of the fin, and at least one foot opening formed in the foot pocket cover.

Other monofin embodiments include a fin with at least one foot pocket assembly coupled to the fin. The at least one foot pocket assembly includes a foot pocket cover, at least one foot hole formed in the foot pocket cover, and at least one cuff surrounding the at least one foot hole. The at least one cuff stretches to encompass an ankle of users of many sizes. The at least one cuff holds the monofin on users.

The foregoing and other features and advantages of the monofin will be apparent to those of ordinary skill in the art from the following more particular description of the invention and the accompanying drawings.

BRIEF DESCRIPTION OF THE DRAWINGS

The invention will hereinafter be described in conjunction with the appended drawings where like designations denote like elements, and.

DESCRIPTION OF THE INVENTION

Figure 1:
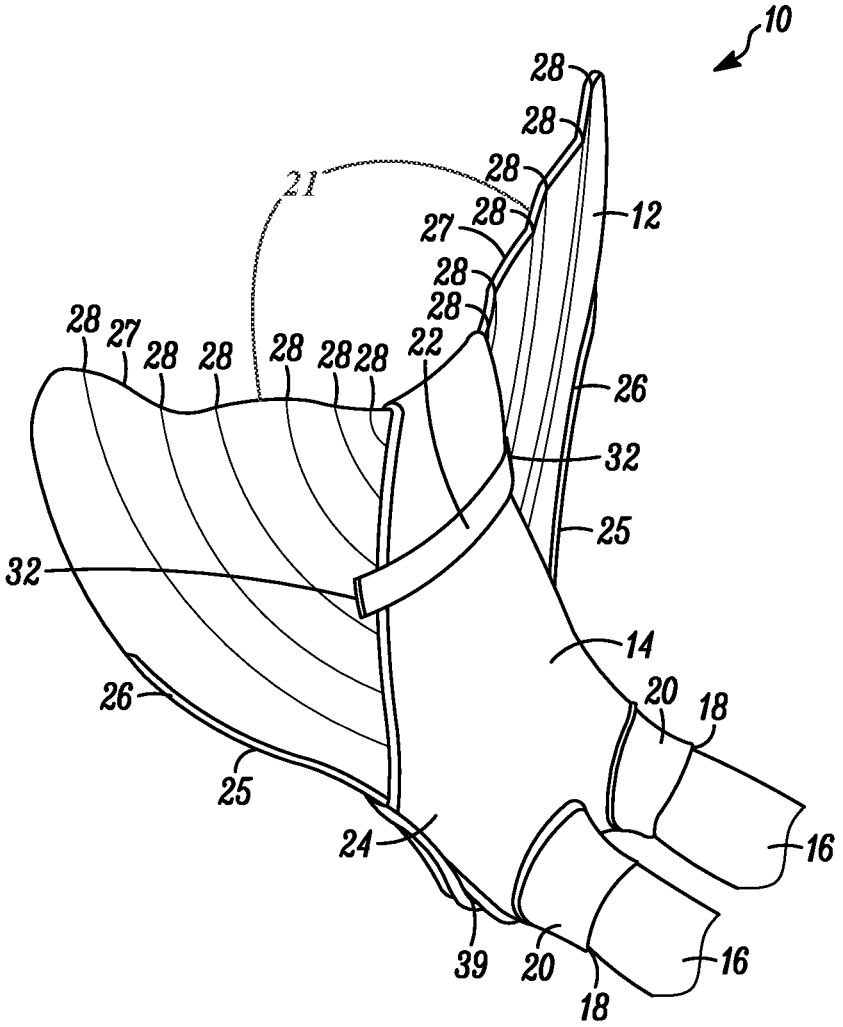
FIG. 1 is an isometric view of a monofin on a user.

As discussed above, embodiments of the present invention relate to a monofin for use while swimming. In particular, disclosed is a monofin which is comfortable, durable and which may be used by many different sizes of user.

FIGS. 1-7 illustrate a monofin 10 consisting of a fin 12 and a foot pocket assembly 14.

The fin 12, as illustrated, is shaped like a whale's tail consisting of two flukes 21. These two flukes 21 are the two halves of the fin 12 which meet in the middle at notch 29. Each fluke 21 is a mirror image of the other. Each fluke 21 is also shaped like a triangle, however, flukes 21 of other shapes such as squares, circles, rectangles, ovals, trapezoids and the like could also be used. While the fin 12 may be any shape desired, shaping fin 12 like a whale's tail is aesthetically pleasing and gives the user the feeling of swimming like a dolphin, whale, mermaid or the like.

Rather than having two flukes 21, as described above, the fin 12 may be any shape desired. The fin 12 may be shaped like a triangle, trapezoid, rectangle, square, oval, circle or the like. The fin 12 may be formed as a single piece or may be formed as multiple pieces coupled together. The fin 12 may also be hinged or the like.

The fin 12, itself, is formed from a thin, flexible, resilient material. The fin 12 must also be formed from a material that is strong enough to withstand the forces applied to it while the fin 12 is in use. Further, the fin 12 must be flexible enough to bend in the water as it is pushed back and forth by a user. Additionally, the fin 12 must resume its original shape when not in use or at other times during the user's stroke. Materials which may be used to form the fin 12 include polymers, plastics, composites, rubber or the like. Other materials with the properties described above may also be used.

The fin 12 has a leading edge 25 and a trailing edge 27. The leading edge 25 is the edge of the fin 12 that is pulled through the water by the user in their swimming stroke. The trailing edge 27 follows the path of the fin 12 through the stroke.

The fin 12 is slightly thicker at the leading edge 25 or back of the fin 12. The fin 12 gradually thins towards the trailing edge 27 or front of the fin 12. This difference in thickness in the fin 12 allows the trailing edge 27 to bend and flex during the user's swimming stroke, while the leading edge 25 is stronger and not as flexible.

The fin 12, further, comprises at least two ribs 26. The at least two ribs 26 begin at the back of the fin 12 as can be seen in the exploded views illustrated in FIGS. 8 and 9. The ribs 26 continue along the leading edge 25 of the fin 12 to a location approximately two thirds of the way down the fin 12. The ribs 26 are a thickening of the edge of the fin 12. The ribs 26 extend above the surface of both the top and the bottom of the fin 12. The ribs 26 add strength and stiffness to the fin 12. By not having the ribs 26 continue to the front of the fin 12, the front portion or trailing edge 27 of the fin 12 is allowed to bend more than the back portion of the fin 12.

While ribs 26 are formed in the surface of the fin 12, the ribs 26 could be formed separately and coupled to the surface of the fin 12. The ribs 26 may be formed from the same material as the fin 12 or they may be formed of other material such as metal, fiberglass or the like. Additionally, the ribs 26 may be reinforced with materials such as metal and the like, while still being formed primarily from the same material as the fin 12.

Ribs 26 may also be placed in other locations on the fin 12. Additional ribs 26 may be placed along the top and bottom surfaces of the fin 12 to add strength to the fin 12.

Additionally, the ribs 26 may be lengthened or shortened in order to change the movement of the fin 12 in the water.

Figure 8:
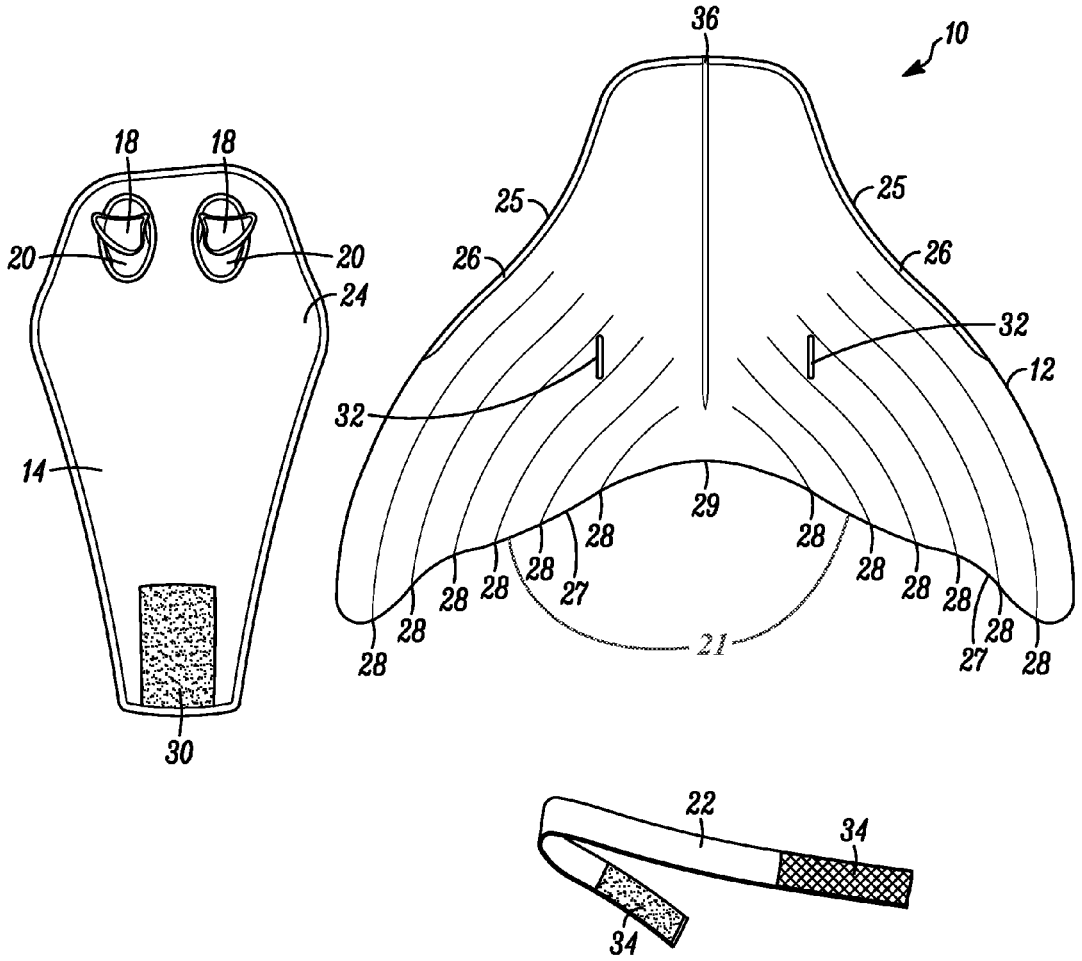
FIG. 8 is an exploded top view of a monofin.

A center rib 36, see FIG. 8, extends down the center of the top of the fin 12. The center rib 36 is a thicker portion of the fin 12 that extends a majority of the length of the fin 12. The center rib 36, like the other ribs 26, adds strength to the fin 12. The center rib 36, also, helps to comfortably separate the user's feet.

While the center rib 36 is illustrated as being formed in the surface of the fin 12, the center rib 36 could be formed separately and coupled to the surface of the fin 12. The center rib 36 may be formed from the same material as the fin 12 or it may be formed of other material such as metal, fiberglass or the like. Additionally, the center rib 36 may be reinforced with materials such as metal and the like, while still being formed primarily from the same material as the fin 12.

Center ribs 36, which are only formed on a single side of the fin 12, may be placed in other locations on the fin 12. Additional center ribs 36 may be placed along the top and bottom surfaces of the fin 12 to add strength to the fin 12.

Additionally, the center rib 36 may be lengthened or shortened to change the movement of the fin 12 in the water.

The center rib 36 may also be thicker than illustrated or may be formed in any other shape desired such as a square, triangle, circle, curved line or the like.

Figure 7:
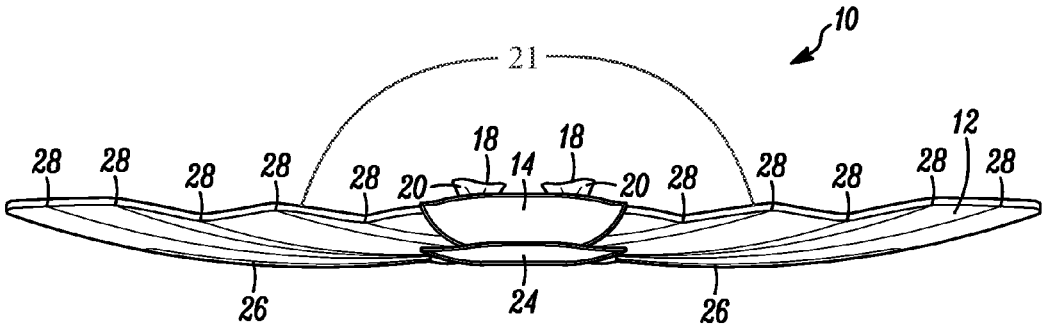
FIG. 7 is a front view of a monofin.

The fin 12 may also contain, include or comprise corrugations 28. The corrugations 28, as seen in FIGS. 1 and 7, are creases formed in the fin 12. The fin 12 is formed with triangular peaks and triangular valleys which extend from the trailing edge 27 of the fin 12 through a majority of the fin 12 towards the leading edge 25. The corrugations 28 are formed with a similar curvature to the leading edge 25 of the fin 12. The path of the corrugations 28, therefore, mimics the shape of the edge of the fin 12. The corrugations 28 are also located parallel to the leading edge 25 of the fin 12, as illustrated in FIGS. 1-4 and 8-10.

While the figures illustrate, corrugations 28 which are formed with sharp triangular peaks and valleys in a triangular wave form, corrugations 28 which are a shaped like a square waveform, sine waveform, sawtooth waveform or the like may also be used. Depending on the shape of the wave form, each corrugation 28 may have a triangular cross section, a square cross section, a curved cross section or the like Additionally, the corrugations 28 could be formed over the entire length of the fin 12 from the back to the front trailing edge 27 or they could be formed in shorter lengths as desired.

The corrugations 28 help to strengthen the fin 12.

Figure 11:
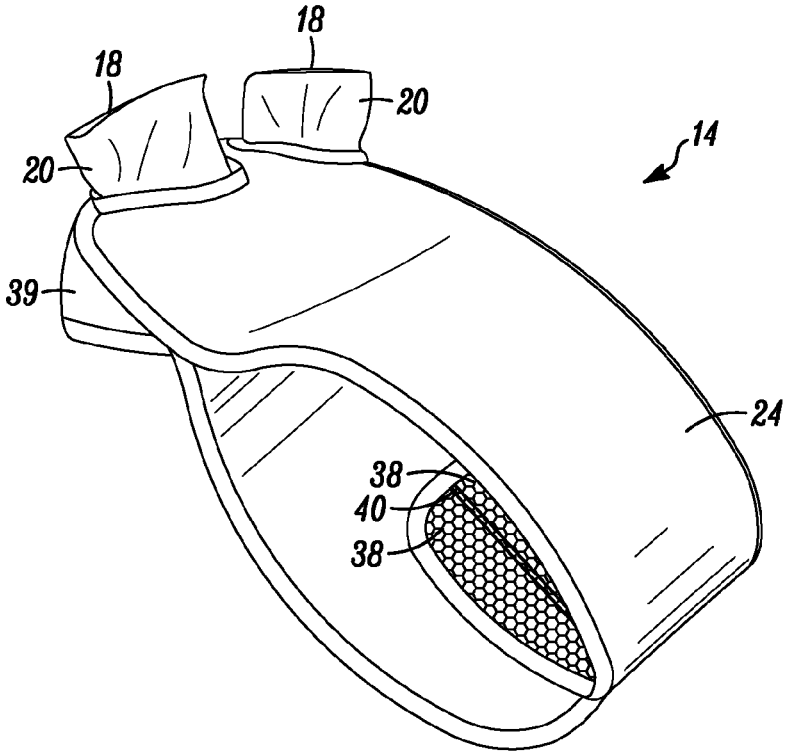
FIG. 11 is an isometric view of a foot pocket assembly.
Figure 12:
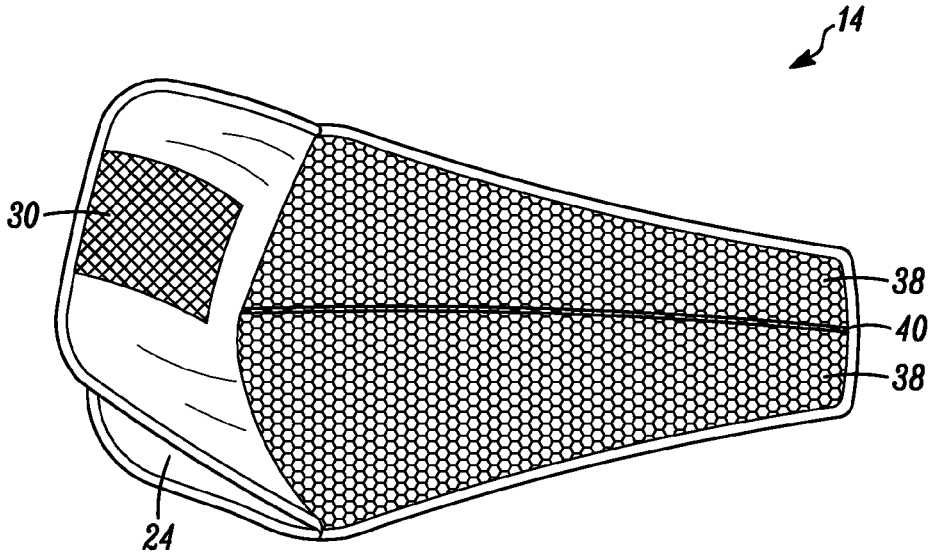
FIG. 12 is an isometric view of an open foot pocket assembly.

The fin 12 is attached to the user's feet through the foot pocket assembly 14. The foot pocket assembly 14 is illustrated separately from the fin 12 in FIGS. 11 and 12.

The foot pocket assembly 14 includes a foot pocket cover 24. The foot pocket cover 24 covers the user's feet while the user is using the monofin 10. The foot pocket cover 24 also acts to attach the foot pocket assembly 14 to the fin 12.

The foot pocket cover 24 may be formed from any material desired. However, it may be preferable to form the foot pocket cover 24 from a material which is soft, flexible and comfortable for users. Additionally, material which is strong, washable and which can withstand harsh pool chemicals may also be desired.

Figure 9:
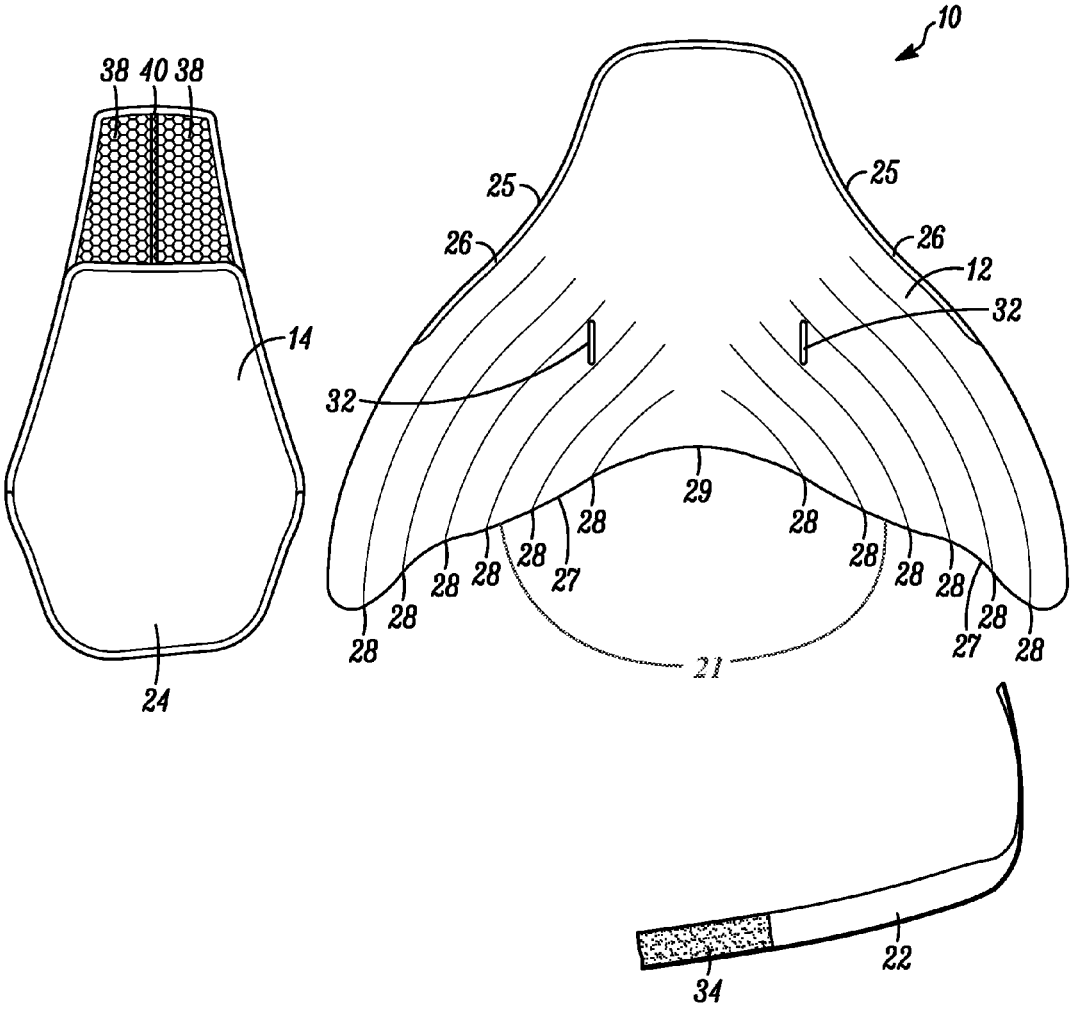
FIG. 9 is an exploded bottom view of a monofin.

The top of the foot pocket cover 24 is shaped like an elongated diamond without a top point as can be seen in FIG. 8. The bottom of the foot pocket cover 24 is shaped like a diamond without a top or a bottom point as can be seen in FIG. 9.

The top of the foot pocket cover 24 and the bottom of the foot pocket cover 24 are coupled together at the back of the foot pocket cover 24 with a gusset 39. The gusset 39 is a piece of material that adds depth to the back portion of the foot pocket cover. The gusset 39 allows room for the heels of the user's feet when the monofin 10 is in use.

Figure 6:
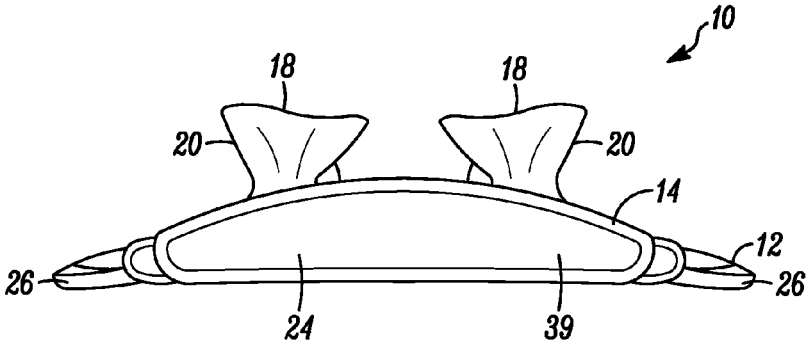
FIG. 6 is a back view of a monofin.

As shown in FIG. 6, the gusset 39 may be shaped as a rectangle which tapers towards the ends. The gusset 39, however, may also be any shape desired, such as a rectangle, square, triangle, trapezoid or the like.

The gusset 39 may be formed from the same material as the rest of the foot pocket cover 24, or the gusset 39 may be formed from a different material with different desirable properties.

The gusset 39 may be permanent or may be removable as desired. The coupling between the gusset 39 and the top and bottom of the foot pocket cover 24 may also be permanent or removable as desired.

The foot pocket cover 24 wraps around the fin 12 as shown in FIGS. 1-4. The back of the foot pocket cover 24 with the gusset 39 is placed over the back of the fin 12. The front of the foot pocket cover 24 is wrapped around the notch 29 of the fin 12.

The foot pocket cover 24 may also be formed to cover more or less of the fin 12 when it is in place.

The front of the foot pocket cover 24 is coupled together using the foot pocket cover couplers 30 shown in FIGS. 8-10 and 12. The foot pocket cover couplers 30 may be any type of coupler that secures the foot pocket cover 24 in a closed position around the fin 12. The foot pocket cover couplers 30 may be hook and loop, snaps, buttons, zippers, adhesives, stitching, stapling or the like.

The foot pocket cover couplers 30 may be permanent or may be removable. Removable foot pocket cover couplers 30 allow the foot pocket cover 24 to be removed for cleaning, replacement or repair of either the foot pocket assembly 14 or the fin 12.

Figure 2:
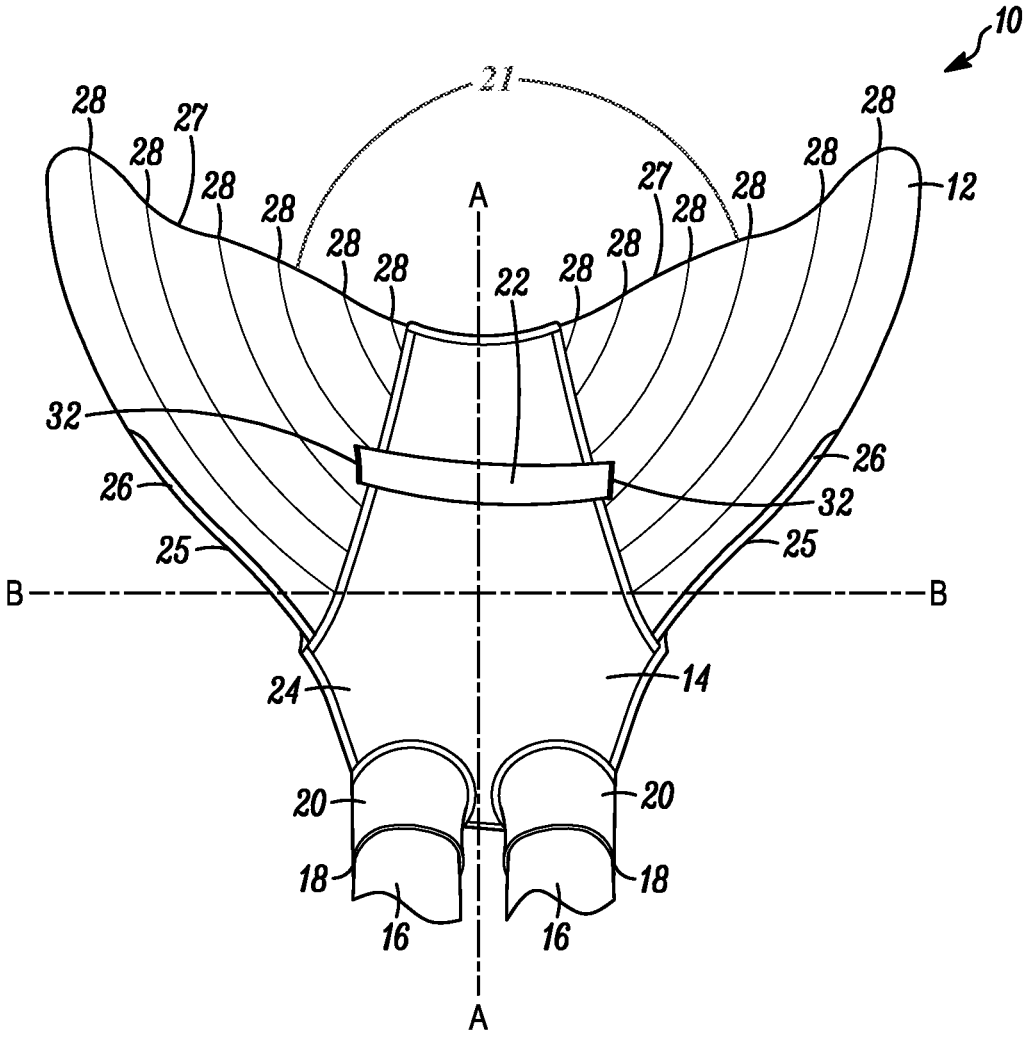
FIG. 2 is a top view of a monofin on a user.
Figure 3:
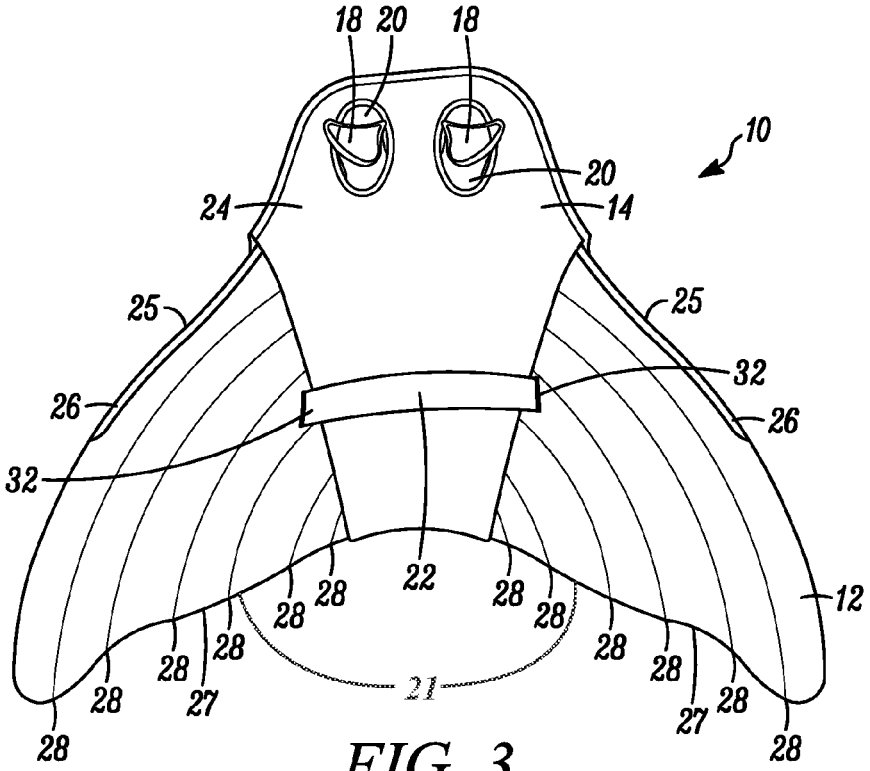
FIG. 3 is a top view of a monofin.

FIGS. 1-3 show the top of the foot pocket cover 24 which has at least one foot opening 18 or foot hole formed in it. Typically, two foot openings 18 will be formed in the top of the foot pocket cover 24. The foot openings 18 are holes formed in the foot pocket cover 24. The foot openings 18 allow the user's feet to be inserted through the top of the foot pocket cover 24.

The foot openings 18 may be formed in any size or shape desirable. They may also be formed at any location in the foot pocket cover 24. However, it is likely that a location towards the back of the foot pocket cover 24 will be desirable.

The foot openings 18 are surrounded or circumscribed by cuffs 20. The cuffs 20 function to hold the monofin 10 on the user's feet. The cuffs 20 are formed from an elastic material with a high degree of elasticity and strength. In order for the cuffs 20 to secure the monofin 10 to the user, the cuffs 20 must stretch to snuggly fit multiple leg or ankle sizes. Once the user stretches the cuffs 20 enough to insert their feet through the foot openings 18, the cuffs 20 automatically tighten due to the elasticity of the material.

The cuffs 20 allow the monofin 10 to fit various sizes of users without any adjustments of straps or the like.

Additionally, the cuffs 20 may be formed from a soft elastic material which is more comfortable than the rubber straps used on typical monofins.

The foot openings or foot holes 18 are in communication with at least one foot pocket 38 shown in FIGS. 9-14. The at least one foot pocket 38 may be a pouch or pocket into which the user's foot is placed during use. The foot pockets 38 as shown in the figures are mesh pockets formed by a piece of mesh material or fabric being coupled to the bottom surface of the top piece of the foot pocket cover 24. The foot pockets 38 comfortably hold the user's feet while allowing them to move freely with nothing stiff to rub against and cause pain.

The foot pockets 38, as illustrated are formed from mesh. The foot pockets 38, however, may be formed from any material desirable, i.e. rubber, fabric, plastic or the like. It may be desirable to have the foot pockets 38 formed from material which is water permeable in order to allow water to move freely around the user's feet.

Additionally, the foot pockets 38 may be permanently or removably coupled to the top surface of the foot pocket cover 24.

In alternate embodiments, no foot pockets 38 may be used. Instead, the user's feet would simply rest on the fin 12 itself The foot pockets 38 are separated by the foot separator 40. The foot separator is a seam at which the foot pocket 38 material is coupled to the bottom surface of the top portion of the foot pocket cover 24. The foot separator 40 will likely be located in the center of the foot pockets 38. Additionally, the foot separator 40 may extend the entire length of the foot pocket cover 24 or may only be partially as long as the foot pocket cover 24.

The foot separator 40 may be formed by stitching the foot pocket 38 fabric to the foot pocket cover 24 or it may be formed by any other coupling means desirable, such as adhesive, heat welding, hook and loop, zippers, snaps and the like.

The foot separator 40 may be permanent or removable.

When in use, the foot pocket cover 24 is placed around the fin 12, as illustrated in FIGS. 1-4, and coupled securely. Then at least one strap 22 is used to strengthen and secure the foot pocket assembly 14 in place. The at least one strap 22 is a rectangular length of material such as webbing which is inserted into two strap openings 32 formed in the fin 12 itself. Once the at least one strap 22 is received through the strap openings 32, the ends of the strap 22 are coupled together using strap couplers 34.

The at least one strap 22 is illustrated separately from the remainder of the monofin 10 in the exploded views shown in FIGS. 8 and 9. As shown in these figures, the at least one strap is a length of material such as would be used for belts or bag straps. Typically this type of material is a form of webbing. The at least one strap 22, however, may be formed in any shape, length or from any material desirable. Though, material with very little elasticity may be desired in order to provide strength to the monofin 10. The at least one strap 22 may be formed from rubber, plastic, fabric, webbing or any other material desired.

On larger embodiments of the monofin 10, multiple straps will likely be used in order to add necessary strength.

The strap 22 is placed through at least two strap openings 32 formed in the fin 12 itself. These strap openings 32 may be formed in any shape desired, however, a small slot the same thickness and height as the strap 22 is sufficient.

Two strap openings 32 formed on either side of the foot pocket assembly 14 are desirable for each strap 22 used. The strap 22 travels through one opening 32, across the foot pocket assembly 14 and through the other strap opening 32.

Figure 4:
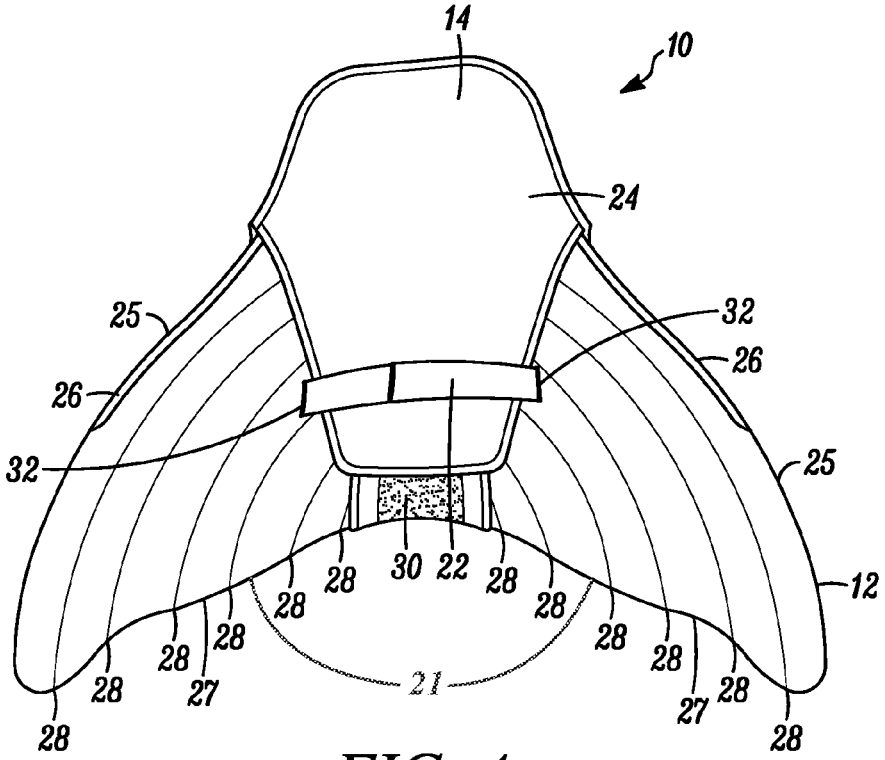
FIG. 4 is a bottom view of a monofin.
Figure 5:
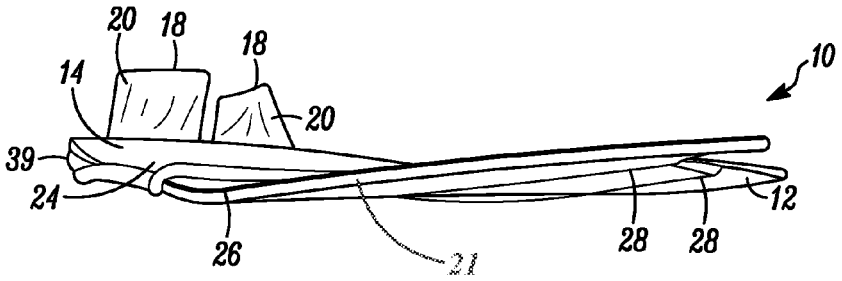
FIG. 5 is a side view of a monofin.
Figure 10:
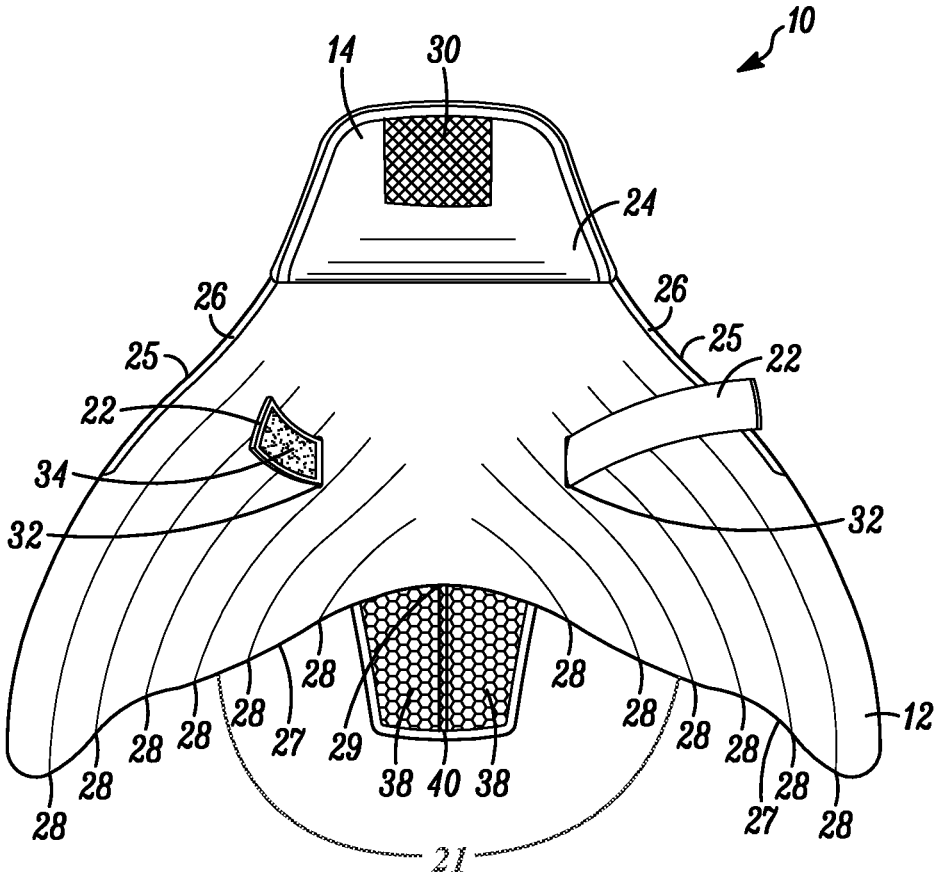
FIG. 10 is a partially exploded bottom view of a monofin.

The strap 22 is then coupled together on the bottom of the monofin 10 below the foot pocket cover 24. FIG. 10 illustrates a monofin 10 with the foot pocket cover 24 and the strap 22 uncoupled. The strap 22 when coupled is illustrated in FIG. 4. The strap 22 may be coupled by any coupling method desired. Strap couplers 34 may include hook and loop, snaps, zippers, buttons, clips and the like. The strap couplers 34 may be adjustable such as hook and loop which may be pulled tighter or snaps which may mate with any number of other snaps.

Additionally, the strap couplers 34 may be removable or permanent couplers.

FIGS. 1, 2, 13 and 14 illustrate the monofin 10 on a user. In order to use the monofin 10, the user places their feet 42 into the foot openings 18. The user's legs 16 are surrounded securely by the cuffs 20.

The user's feet 42 are secured in the monofin 10 by the cuffs 20 surrounding the user's legs 16. As the user is putting the monofin 10 on, the user stretches the cuffs 20 in order to fit them over the user's feet 42 and onto their legs 16. Once the cuffs 20 are on the user's legs 16 or ankles, the cuffs 20 attempt to return to their initial size securely around the user's legs 16. By attaching, the monofin 10 to users in this way, the monofin 10 may easily be used by users of different sizes without the need to adjust straps and the like.

Figure 13:
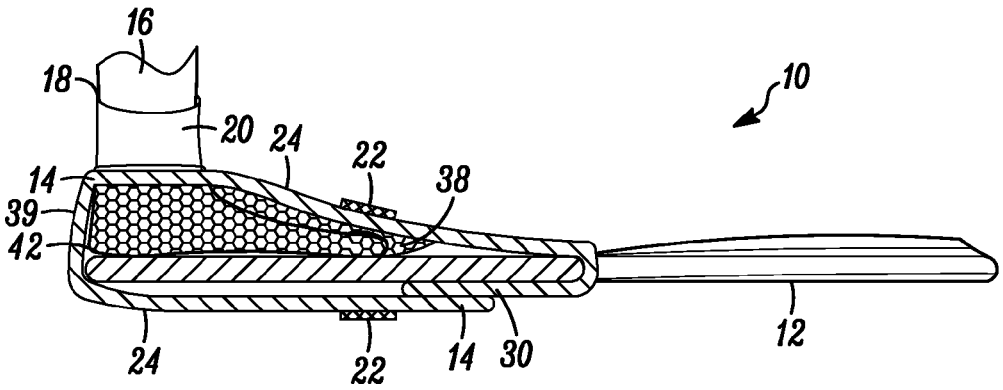
FIG. 13 is a cross section of a monofin taken at line A-A of FIG. 2.
Figure 14:
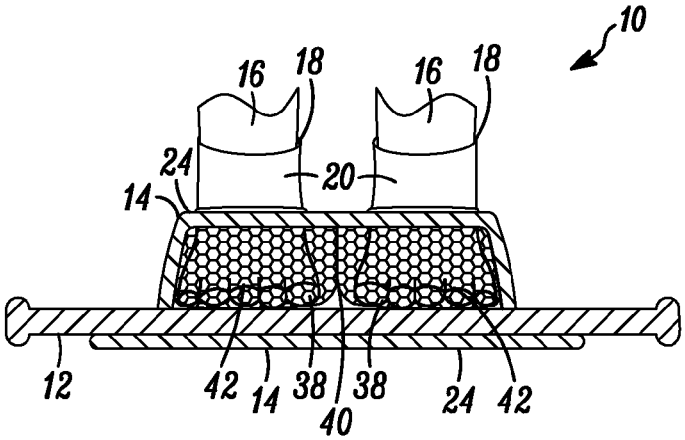
FIG. 14 is a cross section of a monofin taken at line B-B of FIG. 2.

The user's feet 42, as shown in the cross sections illustrated in FIGS. 13 and 14, sit in the foot pockets 38 on the fin 12 itself This allows the user to move the fin 12 upwards by pushing with their feet 42. The user moves the fin downwards by pulling their feet 42 against the foot pocket cover 24 in a downward motion. By moving the fin 12 up and down, the user can propel themselves through the water.

Accordingly, for the exemplary purposes of this disclosure, the components defining any embodiment of the invention may be formed as one piece if it is possible for the components to still serve their function. The components may also be composed of any of many different types of materials or combinations thereof that can readily be formed into shaped objects provided that the components selected are consistent with the intended mechanical operation of the invention. For example, the components may be formed of rubbers (synthetic and/or natural), glasses, composites such as fiberglass, carbon-fiber and/or other like materials, polymers such as plastic, polycarbonate, PVC plastic, ABS plastic, polystyrene, polypropylene, acrylic, nylon, phenolic, any combination thereof, and/or other like materials, metals, such as zinc, magnesium, titanium, copper, iron, steel, stainless steel, any combination thereof, and/or other like materials, alloys, such as aluminum, and/or other like materials, any other suitable material, and/or any combination thereof.

The embodiments and examples set forth herein were presented in order to best explain the present invention and its practical applications and to thereby enable those of ordinary skill in the art to make and use the invention. However, those of ordinary skill in the art will recognize that the foregoing description and examples have been presented for the purposes of illustration and example only. The description as set forth is not intended to be exhaustive or to limit the invention to the precise form disclosed. Many modifications and variations are possible in light of the teachings above without departing from the spirit and scope of the forthcoming claims. Accordingly, any components of the present invention indicated in the drawings or herein are given as an example of possible components and not as a limitation.

The invention claimed is:

1. A monofin comprising:

a fin;

wherein said fin further comprises a leading edge and a trailing edge;

at least one corrugation formed in said fin, wherein said at least one corrugation is parallel to a portion of said leading edge;

at least one foot pocket coupled to said fin; and at least one foot pocket cover coupled to said at least one foot pocket and wherein said at least one foot pocket cover is configured to removably couple around a portion of said fin.

2. The monofin of claim 1, wherein said fin further comprises at least two strap openings and wherein at least one strap is retained in said at least two strap openings.

3. The monofin of claim 1, wherein said fin is shaped like a whale's tail.

4. The monofin of claim 1, further comprising at least one cuff in communication with said at least one foot pocket.

5. The monofin of claim 4, wherein said at least one corrugation has a triangular cross section.

6. A monofin comprising:

a fin;

at least one foot pocket assembly removably coupled to said fin; and wherein said at least one foot pocket assembly comprises:

a foot pocket cover formed to removably couple around a portion of said fin; and at least one foot opening formed in said foot pocket cover.

7. The monofin of claim 6, wherein said fin is shaped like a whale tail comprising a leading edge and a trailing edge.

8. The monofin of claim 7, further comprising at least one corrugation formed in said fin, wherein said at least one corrugation is parallel to a portion of said leading edge.

9. The monofin of claim 6, further comprising at least one cuff surrounding said at least one foot opening, wherein said at least one cuff stretches to secure an ankle of many different sized users.

10. The monofin of claim 6, wherein said fin further comprises at least two strap openings.

11. The monofin of claim 10, further comprising at least one strap in said at least two strap openings.

12. A monofin comprising:

a fin;

at least one foot pocket assembly removably coupled to said fin; and wherein said at least one foot pocket assembly comprises:

a foot pocket cover;

at least one foot hole formed in said foot pocket cover;

at least one cuff surrounding said at least one foot hole;

wherein said at least one cuff stretches to encompass an ankle of users of many sizes; and wherein said at least one cuff holds said monofin on said users.

13. The monofin of claim 12, wherein said fin is shaped like a whale tail and further comprises a trailing edge and a leading edge.

14. The monofin of claim 13, further comprising at least one corrugation formed in said fin, wherein said at least one corrugation is parallel to a portion of said leading edge.

15. The monofin of claim 12, wherein said fin further comprises at least two strap openings and wherein at least one strap is retained in said at least two strap openings.

16. The monofin of claim 12, wherein said foot pocket cover is configured to removably couple around a portion of said fin.

17. The monofin of claim 12, wherein said at least one foot hole is in communication with at least one foot pocket.

18. The monofin of claim 17, wherein said at least one foot pocket is formed from a mesh material.

19. The monofin of claim 12, wherein said foot pocket cover is formed from soft, flexible material.

* * * * *